United States Patent [19]

Quinn

[11] 4,048,042

[45] Sept. 13, 1977

[54] APPARATUS FOR ELECTROPLATING PLASTIC INSULATING CABLE SHEATHS

[75] Inventor: Edward J. Quinn, E. Amherst, N.Y.

[73] Assignee: Hooker Chemicals & Plastics Corporation, Niagara Falls, N.Y.

[21] Appl. No.: 646,453

[22] Filed: Jan. 5, 1976

[51] Int. Cl.[2] ..... C25D 5/04; C25D 7/06; C25D 17/12

[52] U.S. Cl. ..... 204/206; 204/28

[58] Field of Search ..... 204/28, 206–211, 204/275

[56] References Cited

U.S. PATENT DOCUMENTS

| | | | |
|---|---|---|---|
| 1,312,756 | 8/1919 | Stover | 204/238 X |
| 3,189,532 | 6/1965 | Chow et al. | 204/28 |
| 3,441,494 | 4/1969 | Oshima et al. | 204/228 |
| 3,474,009 | 10/1969 | Wang | 204/35 |
| 3,637,466 | 1/1972 | Girard | 204/1 T |
| 3,736,576 | 5/1973 | Toledo | 340/174 PW |
| 3,799,804 | 3/1974 | Girard et al. | 204/207 X |
| 3,869,355 | 3/1975 | Mathias | 204/32 R |

FOREIGN PATENT DOCUMENTS

| | | | |
|---|---|---|---|
| 19,361 | 7/1970 | Japan | 204/206 |
| 4,167 | 2/1968 | Japan | 204/DIG. 5 |
| 16,201 | 7/1968 | Japan | 204/DIG. 5 |
| 599,188 | 3/1948 | United Kingdom | 204/206 |

*Primary Examiner*—F.C. Edmundson

*Attorney, Agent, or Firm*—Peter F. Casella; William J. Crossetta, Jr.; Arthur S. Cookfair

[57] ABSTRACT

An apparatus is provided for electroplating wire cable having a plastic sheath which has been made conductive. The apparatus comprises a T-tube containing one or more anodes having a geometric configuration which creates an electric field substantially symmetric about any point on the axis of the T-tube along which the cable passes during the plating operation. Means are provided for cathode contact, for advancing the cable through the apparatus, and for maintaining a proper level of plating solution.

5 Claims, 2 Drawing Figures

APPARATUS FOR ELECTROPLATING PLASTIC INSULATING CABLE SHEATHS

BACKGROUND OF THE INVENTION

This invention relates to the preplating and electroplating of plastic sheaths covering a conductive core to form coaxial cable.

U.S. Pat. No. 3,681,511 discloses a process comprising subjecting a substrate to a member of the group of elemental phosphorus and low oxidation state phosphorus compounds, and thereafter to a metal salt or complex thereof in order to provide a coating on the substrate for use in the production of electrostatic and magnetostatic shielded wires and antistatic textiles. Although the process can be used in a laboratory, it has been found that in large scale continuous operations, electroplating the plastic sheaths using conventional apparatus may result in the cracking of the electroplated layer.

U.S. Pat. No. 3,579,430 discloses an apparatus for electroplating in which copper wire is tinned prior to being covered by insulating material. This apparatus basically comprises a double trough system in which a smaller plating trough is enclosed in a larger overflow trough. The untrimmed wire is advanced horizontally through the trough and has contact only with the solution by virtue of the external support of pulley on either end of the outside trough which maintain the desired tension in the wire. A disadvantage of this apparatus is that the anodes are not symmetrical with respect to the geometry of the wire to be electroplated. Since electroplating on plastics, as opposed to electroplating wire, may require more critical adjustment of the geometric configurations of the apparatus, this could be a critical disadvantage.

A possible solution to this problem is to use a T-tube. Although the use of T-tubes generally in plating operations is old, such use has been confined to electroless plating in which no anodes are needed. While it may be apparent that the particular geometry of the T-tube is compatible with the geometry of the plastic sheathed wire, it has not been apparent what combination of tube and anode configuration would allow the production of coaxial cable in commercial quantities.

SUMMARY OF THE INVENTION

It has been surprisingly discovered that wire cable having a conductive wire core and an outer plastic sheath which has been made conductive may be electroplated in a continuous operation using a T-tube apparatus. The T-tube preferably has an elongated cylindrical portion having openings at each end through which the cable passes and a T-inlet portion through which plating solution is added and from which air may escape. One or more anodes are mounted in the cylindrical portion. The anodes have a geometric configuration, which in a preferred embodiment is a spiral, which creates an electric field which is substantially symmetric with respect to the axis of the elongated cylindrical portion of the T-tube along which the cable passes. Means are provided for maintaining the proper level of plating solution in the T-tube, and may include a pump and a filter in a preferred embodiment. Also provided are means for advancing the cable through the T-tube which may include one or more pulleup external of the T-tube which serve as cathode contact means.

The invention also includes a process for electroplating wire cable having a plastic sheath which has been pretreated to make it conductive, which broadly comprises advancing the cable over contact means through a plating solution in the presence of one or more anodes having a geometric configuration which creates an electric field which is substantially symmetric along the surface of the cable.

THE DRAWINGS

DETAILED DESCRIPTION

Figure 1:
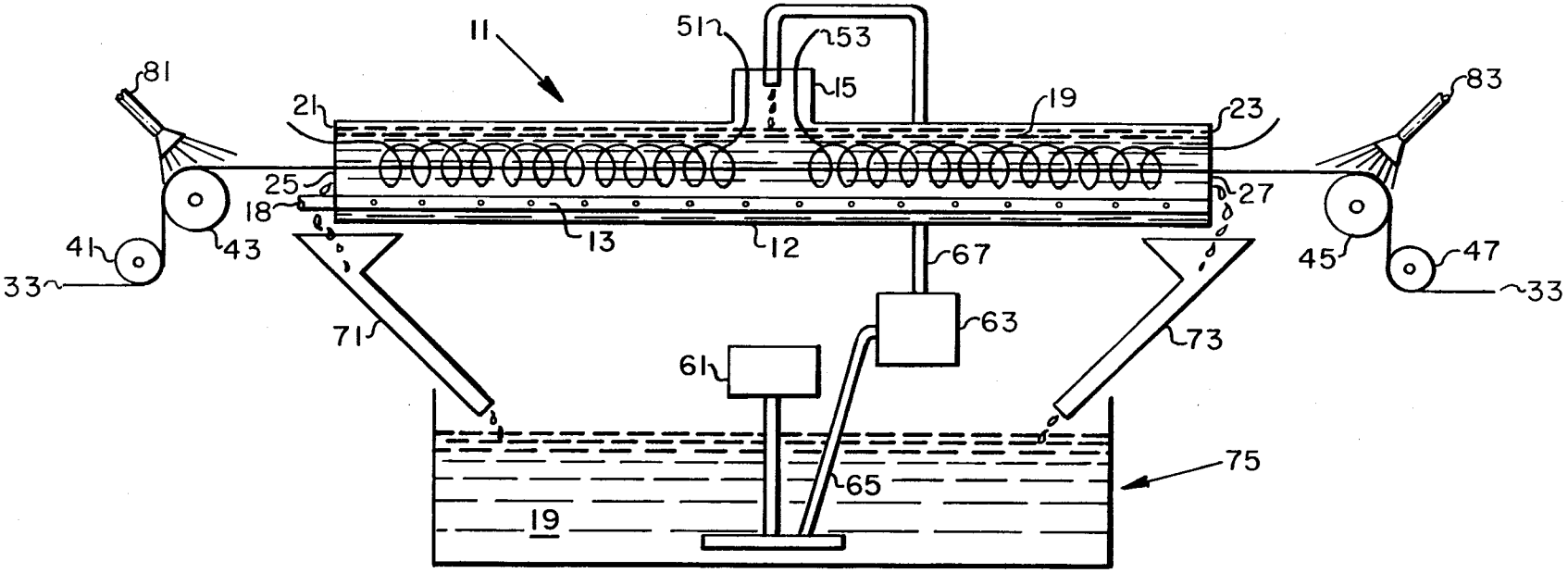
FIG. 1 is a diagrammatic plan view of the apparatus in the operating mode. Means for supporting the T-tube are well known in the art, and thus, are not shown.
Figure 2:
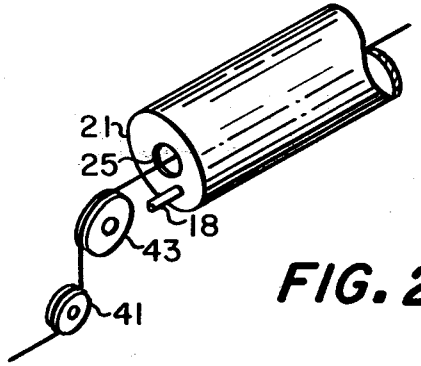
FIG. 2 is a partial isometric view of the T-tube showing an end.

A T-tube 11, having an elongated section 12 and a T-inlet 15 perpendicular to the elongated section, contains two anodes 51, and 53 and electroplating solution 19. Each end 21 and 23 of the elongated portion 12 of the T-tube is enclosed with the exception of centrally located opening 25 and 27. This opening may be any size but is preferably on the order of about four times the outside diameter of the plastic cable insulating sheath of the cable 33 which is to be electroplated.

The cable 33 to be plated in this apparatus is defined as a plastic sheath having a conductive outer surface covering a conductive core. Plastics which may be used in this invention are listed in the discussion of the preferred process which follows below.

Cable 33 which is suitable for electroplating in this apparatus has preferably been preplated according to the process described below. Preplated cable 33 is advanced from a supply source (not shown) over a series of pulleys 41, 43 and enters the elongated section 12 of the T-tube 11 through central opening 25 of end 21. The cable passes horizontally through the elongated section which contains one or more anodes, through central opening 27 of end 23, and finally passes over pulleys 45, 47 to a take up reel (not shown).

The tube 11 contains one or more anodes which may be copper or other suitable material and which serve to complete the electric circuit. Sacrificial anodes, such as copper, may be used to replace the ions in the solution which are electroplated onto the cable sheath. Non sacrificial anodes may also be used. The one or more anodes have a geometric configuration which creates an electric field that is substantially radially uniform at any point on the axis of the elongated cylindrical portion 12 of the tube 11. The advantage of such a configuration is that an electric field, which is substantially radially uniform at any point on the axis of the tube, tends to cause the cable sheath which passes along the axis to plate uniformly. This may be of great importance in making co-axial cables by the process of electroplating the plastic sheath of a wire cable.

One preferred geometrical configuration for the anode is a spiral. In a preferred embodiment, the one or more anodes comprise two copper spirals 51 and 53 which are co-axial with the axis (along which the cable 33 passes) of the elongated cylindrical portion.

In a preferred embodiment, the two anodes comprise an inlet anode 51 (which is the anode through which the cable first passes), and an outlet anode 53. The inlet anode 51 may have a plating current density within the limits of the range from about the threshold plating potential of the ion with which the sheath is to be plated to about the current density which is great enough to burn off the preplate. For a copper plating solution, this range may vary from about 3 amperes per square foot to about 60 amperes per square foot. More preferably the range may be from about 10 amperes per square foot to about 50 amperes per square foot. Even more preferably the range may be from about 15 amperes per square foot to about 35 amperes per square foot. The outlet anode 53 may have a greater current density than the inlet anode because the cable sheath passing through the outlet anode has a thin coating of copper which was deposited when it passed through the inlet anode, thus making it more conductive. Thus the outlet anode preferably may have a current density in the range of about 20 amperes per square foot to about 100 amperes per square foot. More preferably the range may be from about 30 amperes per square foot to about 80 amperes per square foot. Even more preferably, the range is from about 35 amperes per square foot to about 65 amperes per square foot. The cathode contacts of the electroplating system may be the electrical contact pulleys 43 and 47 over which the electrically conductive preplated cable passes as it enters and exits the tube. The electrical contact pulleys are preferably graphite, but can be any composition which is sufficiently conductive. Power is supplied to the electrodes by power supply means (not shown) which are well known in the art and may preferably be one or more D. C. rectifiers.

The T-tube is continuously fed with plating solution 19 held in plating solution tank 75 by means of a pump 61 which feeds the plating solution to a filter 63 by connecting means 65 from which the solution passes to the T-inlet 15 by means of connecting means 67. Suitable pumps and filters are well known in the plating art. Preferably the end 16 of T-inlet 15 is open and of a larger diameter than connecting means 67 in order to allow air to escape from the solution 19. When the T-tube apparatus is in operation, plating solution overflows through central openings 25 and 27 to overflow conduits 71, 73 which route it back to the plating solution tank 75.

In a preferred embodiment, the elongated portion 12 is provided with an air sparger tube 13 which bubbles substantially uncontaminated (especially oil free) air through the solution. This causes agitation of the plating solution 19, and thus gives a more uniform distribution of ions through the plating solution. The air sparger tube is provided with air from suitable means (not shown) which are well known in the plating art. The air to the air sparger tube is may be provided through a transporting tube 18 which extends through either end 21, 23 of the elongated portion of the tube and which forms a liquid-tight seal with the end of the elongated portion is of the tube. Alternatively, (not shown) the air supply could be routed to the air sparger tube 13 by a transporting tube which entered the T-inlet portion 15 of the tube 11.

In operation the cable 33 passes through idler pulley 41 which is situated in such a manner as to ensure sufficient electrical contact with electrical contact pulley 43. It then passes longitudinally through the T-tube 11 as described above, and then onto electrical contact pulley 45 and idler pulley 47 which is disposed in substantially the same arrangement and to serve the same function as idler pulley 41. The tension on the cable 33 should be controlled by tension controlling means (not shown) which ensures that the cable 33 makes no contact with any apparatus other than the pulleys.

It may be preferred to have water directing means 81 deposit water on the electrical contact pulley 43 and on the portion of the sheath of the cable 33 which is about from the point of contact with the pulley to the point of entry 25 into the T-tube. The water, or other suitable agent, serves the purpose of cooling the cable, increasing the conductivity of the preplated sheath, and lubricating the pulley to lessen the abrasion of the cable on the grooved portion of the pulley. In preferred embodiments, the water may be deposited on the cable either in liquid form or as a fog.

It may also be preferred to provide means 83 for directing an inert gas such as $N_2$ onto the portion of the plated cable which is between central opening 27 and the final point of contact with electrical contact pulley 45. Because current flows through this portion of the cable, it has a tendency to oxidize upon exposure to ambient air. Blowing an inert gas on this portion of the cable tends to lessen the oxidation and also helps cool the cable.

The cable is passed through the T-tube and electroplating solution at a continuous rate which is controlled by motor and friction means (not shown) which are well known in the art. The time of immersion of the cable in the electroplating solution, and thus, the feed rate of the cable is dependent upon the particular electroplating process used. One such process, using phosphorous or low oxidation number compounds of phosphorus, is discussed below.

The electroplating solution 19 is pumped into the T-inlet 15 at a rate which is about equivalent to the rate at which the solution escapes through the central openings 25 and 27. When the apparatus is not in use, the solution level will reach a level just below the lowest point of the central opening. When the apparatus is in operation, the level of the electroplating solution should be preferably on the order of 90% of the volume of the body of the tube in order to enclose the anode and cable.

Typical plastics to which the metal plating process of U.S. Pat. No. 3,681,511 is applicable, for at least some applications include the homopolymers and copolymers of ethylenically unsaturated aliphatic, alicyclic and aromatic hydrocarbons such as polyethylene, polypropylene, polybutene, ethylenepropylene copolymers; copolymers of ethylene or propylene with other olefins, polybutadiene; polymers of butediene, polyisoprene, both natural and synthetic, polystyrene and polymers of pentene, hexene, heptene, octene, 2-methyl-propene, 4-methyl-hexene-1, bicyclo (2.2.1.)-2-heptene, pentadiene, hexadiene, 2,3-dimethylbutadiene-1,3,4-vinylcyclohexene, cyclopentadiene, methylatyrene, and the like. Other polymers useful in the invention include polyidene, indenecoumarone resins; polymers of acrylate esters and polymers of methlacrylate esters, acrylate and methacrylate resins such as ethyl acrylate, n-butyl methacrylate, isobutyl methacrylate, ethyl methacrylate and methyl methacrylate; alkyd resins; cellulose derivatives such as cellulose acetate, cellulose acetate butyrate, cellulose nitrate, ethyl cellulose, hydroxyethyl cellulose, methyl cellulose and sodium carboxymethyl cellulose; epoxy resins; furan resins (furfuryl alcohol or furfural ketone); hydrocarbon resins from petroleum; isobutylene resins (polyisobutylene); isocyanate resins (polyurethanes); melamine resins such as melamine-formaldehyde and melamine-ureaformaldehyde; oleoresins; phenolic resins such as formaldehyde.

Before the cable can be electroplated to form a coaxial cable, the surface of the plastic sheath must be made conductive. The preferred method for rendering the plastic sheath conductive is a process which exposes the sheath to either elemental phosphorus or low oxidation state phosphorus compounds such as phosphorus sesquisulfide and thereafter to a metal salt or complex thereof. This is generally referred to as a "preplating" (as opposed to "electroplating") process.

In the process of U.S. Pat. No. 3,681,511 the substrate is subjected to a member of the group of elemental white phosphorus and low oxidation state phosphorus compounds, and thereafter to a metal salt or complex thereof. This process is described in copending applications Ser. No. 614,541, filed Feb. 8, 1967, Ser. No. 750,488, filed Aug. 6, 1968 now U.S. Pat. No. 3,520,403, Ser. No. 855,037, filed Sept. 3, 1969 and now abandoned, Ser. No. 847,423, filed Aug. 4, 1969, and now abandoned and in Ser. No. 23,967, filed Mar. 30, 1970, which disclosures are hereby incorporated by reference. U.S. Pat. No. 3,650,708 discloses the treatment of a non-metallic substrate with phosphorus sesquisulfide and is incorporated herein by reference.

The subjection to elemental white phosphorus, which includes the various impure or commercial grades sometimes referred to as yellow phosphorus, can be effected when the phosphorus is in the vapor phase, is a liquid, or is dissolved in a solvent. Suitable solvents or diluents for the elemental phosphorus are solvents which dissolve elemental phosphorus and which preferably swell the surface of a plastic without detrimentally affecting the surface of the plastic. Such solvents include the halogenated hydrocarbons and halocarbons such as chloroform, methylchloroform, dichloroethylene, trichloroethylene, perchloroethylene, and the like: aromatic hydrocarbons such as benzene, toluene, xylene, and the like. The solution concentration is generally in the range from about 0.0001 weight percent of phosphorus based on the weight of the solution up to a saturated solution, and preferably from about 0.1 to about 2.5 percent. Generally the temperature is in the range of about 30° to 135° C., but preferably in the range of about 50° to 100° C. The contact time varies depending on the nature of the substrate, the solvent and temperature, but is generally in the range of about 1 second to 1 hour or more, preferably in the range of about 1 to 10 minutes.

Alternatively, the substrate can be subjected to at least one low oxidation state phosphorus compound, i.e. wherein the phosphorus has a valence of less than 5, preferably in a solvent. Suitable low oxidation state compounds are trihydroxymethyl phosphine; phosphorus sesquisulfide; $P_4H_2$; phosphine, diphosphine, hypophosphorus acid and salts thereof of the metals of Groups I, II and III; phosphorus acid and the salts thereof of the metals of Groups I, II, and III, and low oxidation state phosphorus compounds prepared by reacting elemental phosphorus with a suitable nucleophilic reagent or organo metallic compound (including Grignard reagents). Suitable nucleophilic reagents include basic compounds having an unshared pair of electrons on a carbon, oxygen, nitrogen, sulfur or phosphorus atom. The preferred nucleophilic reagents have the formula MX wherein M is an alkali metal or alkaline earth metal and Z is hydroxide, alkoxide, amide, sulfite, thiosulfate, mercaptide, cyanate, thiocyanate, cyanide, azide, and the like.

A solution of phosphorus sesquisulfide can be employed in the process. Suitable solvents or diluents for the phosphorus sesquisulfide are solvents that dissolve the phosphorus sesquisulfide and which preferably swell the surface of a plastic without detrimentally affecting the surface of the plastic. Such solvents include the halogenated hydrocarbons and halocarbons such as chloroform, methyl chloroform, phenyl chloroform, dichloroethylene, trichloroethylene, perchloroethylene, trichloroethane, dichloropropane, ethyl dibromide, ethyl chlorobromide, propylene dibromide, monochlorobenzene, monochlorotoluene and the like; aromatic hydrocarbons such as benzene, toluene, xylene, ethyl benzene, naphthalene and the like; ketones such as acetone, methyl ethyl ketone, and the like; acetic acid; acetic acid trichloroethylene mixtures; carbon disulfide; and the like.

When a solution of phosphorus sesquisulfide is employed in the process, the solution concentration is generally in the range from about 0.0001 weight percent of phosphorus sesquisulfide based on the weight of the solution up to a saturated solution, and preferably from about 0.5 to about 2.5 percent. Prior to contacting the substrate with the phosphorus sesquisulfide, liquid or solution, the surface of the substrate should be clean. When a solution is used, the solvent generally serves to clean the surface. A solvent wash may be desirable when liquid phosphorus sesquisulfide is employed. The phosphorus sesquisulfide treatment is generally conducted at a temperature below the softening point of the substrate, and below the boiling point of the solvent, if the solvent is used. Generally, the temperature is in the range of about 0° to 135° Centigrade, but preferably in the range of about 15° to 75° Centigrade. The contact time varies depending on the nature of the substrate, the solvent and temperature, but is generally in the range of about 1 second to 1 hour or more, preferably in the range of about 1 to 20 minutes.

The substrate can, if desired, be subjected to the solvent prior to subjection of the phosphorus or low oxidation state phosphorus compound in order to improve the quality of the resulting metal coating. It has been found that subjection of the substrate to the solvent hereinbefore disclosed prior to subjection to the phosphorus sesquisulfide has a very marked effect on the adhesion of the final metal plated article. The temperature of the solvent is directly related to the adhesion realized. Generally, the temperature is in the range of about 30° Centigrade to the boiling point of the solvent, preferably about 50° to 100° and higher than the temperature of the solution of phosphorus sesquisulfide, if a solution is used. The contact time varies depending on the nature of the substrate, solvent and temperature but preferably is 1 to 15 minutes.

As a result of the above treatment step, the phosphorus sesquisulfide is deposited at the surface of the substrate. By this is meant that the phosphorus sesquisulfide can be located on the surface, embedded in the surface and embedded beneath the surface of the substrate. The location of the phosphorus sesquisulfide is somewhat dependent on the action of the solvent on the surface if one is used.

Following the above treatment step, the substrate can be rinsed with a solvent, and then can be dried by merely exposing the substrate to the atmosphere or to inert atmospheres such as nitrogen, carbon dioxide, and the like, or by drying the surface with radiant heaters or in a conventional oven. Drying times can vary considerably, for example, from 1 second to 30 minutes or more, preferably 5 seconds to 10 minutes, more preferably 5 to 120 seconds. The rinsing and drying steps are optional.

In the next treatment step of the preferred preplating process the phosphorus sesquisulfide treated substrate is contacted with a solution of a metal salt or a complex of a metal salt, which is capable of reacting with the phosphorus to form a metal-phosphorus-sulfur compound. The term metal-phosphorus-sulfur compound used herein, means the metal-phosphorus-sulfur coating which is formed at the surface of the substrate. Without being limited to theory the metal-phosphorus-sulfur compound may be an ionic compound or a solution (alloy). The metals generally employed are those of Groups IB, IIB, IVB, VB, VIIB, and VIII of the Periodic Table. The preferred metals are copper, silver, gold, chromium, vanadium, tantalum, cadmium, tungsten, molybdenum, and the like.

The metal salts that are used in the invention can contain a wide variety of anions. Suitable anions include the anions of mineral acids such as sulfate, chloride, bromide, iodide, fluoride, nitrate, phosphate, chlorate, perchlorate, borate, carbonate, cyanide, and the like. Also useful are the anions of organic acids such as formate, acetate, citrate, butyrate, valcrate, caproate, stearate, oleate, palmitate, dimethylglyoxime, and the like. Generally, the anions of organic acids contain one to 18 carbon atoms.

Some useful metal salts include copper sulfate, copper chloride, silver nitrate, nickel chloride and nickel sulfate.

The metal salts can be complexed with a complexing agent that produces a solution having a basic pH (7). Particularly useful are the ammonical complexes of the metal salts, in which one to six ammonia molecules are complexed with the foregoing metal salts. Typical examples include $NiSO_46NH_3$, $NI(C_2H_2O_2)_2\ 6NH_2$, $CuSo_46NH_2$, $CuCl_26NH_2$, $AgNO_26NH_3$, $NiSO_43NH_2$, $CuSO_44NH_3$, $NiCl6NH_2Ni(NO_3)_24NH_3$, and the like. Other useful complexing agents include quinoline, amines and pyridine. Useful complexes include compounds of the formula MX O wherein M is the metal ion, X is chlorine or bromine and Q is quinoline. Typical examples include: $CoCl_2O_3$, $CoBr_2O_2$, $NiCl_2O_2$, $NiBr_2O_2$, $CuCL_2O_2$, $CuBr_2O_2$ and $ZnCl_2O_2$. Useful amine complexes include the mono-(ethylenediamine), bis-(ethylenediamine)-, tris(ethylenediamine)-, bis(1,2-propane diamine)-, and bis-(1,3-propanediamine)-complexes of salts such as copper sulfate. Typical pyridine complexes include $NiCl_2(py)_2$ and $CuCl_2(py)_2$ where py is pyridine.

The foregoing metal salts and their alcohol, are used in ionic media, preferably in aqueous solutions. However, nonaqueous media can be employed such as alcohols, for example, methyl alcohol, ethyl alcohol, butyl alcohol, heptyl alcohol, decyl alcohol and the like. Mixtures of alcohol and water can be used. Also useful are ionic mixtures of alcohol with other miscible solvents of the types disclosed hereinbefore. The solution concentration is generally in the range from about 0.1 weight percent metal salt or complex based on the total weight of the solution up to a saturated solution, preferably from about 1 to about 10 weight percent metal salt or complex. The pH of the metal salt or complex solution can range from about 4 to 14, but is generally maintained in the basic range, i.e., greater than 7, and preferably from about 10 to about 13.

The treated articles provided by the processes hereinbefore described can be electroplated in the apparatus of this invention to provide electrostatic and magnostatic shielding of cables and wires. By wires or cables is meant a conductor such as a copper wire which is encased in a dielectric sheath of a substrate hereinbefore described or having a layer of such substrate upon the dielectric sheath. The wire or cable is subjected to the process hereinbefore described so as to provide a conductive preplate coating which is subsequently electroplated in the apparatus of this invention with conventional electroplating solution to provide electrostatic and magnostatic shielding which is equal to or better than conventional shielding such as, e.g., a copper wire braided shield. Typical electroplating processes are disclosed in "Metal Finishing Guidebook Directory" for 1967, Published by Metals and Plastics Publications, Inc., Westwood, New Jersey.

The following examples illustrate certain preferred embodiments of the present invention. Unless otherwise indicated in this specification and claims, all parts and percentages used herein are by weight and all temperatures are in degrees centigrade.

EXAMPLE 1

A sample of Alpha No. 3053 wire (copper encased in polyvinyl chloride) was subjected to a 2 percent solution of white phosphorus in trichloroethylene at 65° C. for 1 minute. Thereafter the wire was subjected for 4 minutes to an ammoniacal solution of nickelous acetate containing excess ammonium hydroxide at 70° C. and then for 15 seconds to an ammoniacal solution containing 7 percent silver nitrate at room temperature. The surface evidenced conductivity when tested with an ohm meter.

EXAMPLE 2

Wire, which was insulated with polyvinylchloride, was subjected to a 2 percent solution of white phosphorus in trichloroethylene at 62°–63° C. for one minute and dried in air for 10 seconds. The treated substrate was then subjected to a 5 percent nickel solution for 5 minutes at 70°–73° C. Therafter the substrate was subjected for 2 minutes to a room temperature solution which had been prepared by adding ammonium hydroxide to a mixture of 40 grams of water and 2 grams of silver nitrate until the solution was clear and then adding nitric acid dropwise until the pH was 7.5–8. The resulting adherently bound metal phosphide coating had a resistance of 50–200K ohms.

EXAMPLE 3

Sixty feet of coaxial cable was stripped of its copper braid covering so that the polyethylene sheath covering the conductive core was exposed. The polyethylene sheath was preplated by the following process at an average rate of 2 feet per minute:

| Consecutive Step | Preplating Solution | Treated by | Treated Temp. | Minutes of Treatment | Minutes of Air Exposure After Treatment |
|---|---|---|---|---|---|
| 1 | 0.6% by weight $P_4$ dissolved trichloroethylene | Immersion | 40° C | 1.3 | 2.0 |
| 2 | Distilled $H_2O$ | Spray | ambient | 0.3 | 0.5 |

-continued

| Consecutive Step | Preplating Solution | Treated by | Treated Temp. | Minutes of Treatment | Minutes of Air Exposure After Treatment |
|---|---|---|---|---|---|
| 3 | 0.03 Mol $AgNo_3$/ 0.16 Mol ethylene-diamine/$H_2O$ | T-tube | 70° C | 2.5 | 1.1 |
| 4 | Distilled $H_2O$ | Spray | ambient | 1.0 | 0.3 |
| 5 | None | over-drying | 85° C | 3.5 | — |

EXAMPLE 4

The $P_4$/Ag preplated cable of Example 3 was treated with electroless copper at a rate of 10 linear inches of cable per minute at a solution temperature of 55° to 65° C to yield 60 feet of copper preplated cable. The cable was then electroplated with copper using the T-tube plating.

Various changes and modifications can be made in the process and products of this invention without departing from the spirit and scope of the invention. The various embodiments of the invention disclosed herein serve to further illustrate the invention but are not intended to limit it.

What is claimed is:

1. Apparatus for electroplating a wire cable having a plastic sheath with a conductive surface comprising:

a t-shaped tube having an elongated cylindrical portion and a t-inlet portion, each end of the elongated cylindrical portion having a central opening which is substantially coaxial with the axis of the cylinder and is at least larger than the outer diameter of the cable; cathode means external of the tube which are in electrical contact with the conductive sheath of the cable;

one or more anodes having a spiral configuration such that the axis of the spiral is approximately coaxial with the axis of the elongated cylindrical portion of the tube and which creates an electric field which is substantially uniform about the axis of the elongated cylindrical portion of the tube;

means for guiding the cable into the elongated cylindrical portion of the tube via one central opening, along the axis of the spiral and the axis of the cylindrical portion, and out of the tube via the other central opening, so that the axis of the portion of the cable in the cylindrical section of the tube is approximately coaxial with the cylindrical portion;

means for capturing plating solution which flows out of each central opening at the end of each cylindrical portion; and means for adding the plating solution into the t-inlet of the tube.

2. The apparatus of claim 1 wherein the one or more anodes comprise an inlet anode and an outlet anode.

3. The apparatus of claim 2 wherein the outlet anode is maintained at a current density greater than that of the inlet anode.

4. The apparatus of claim 1 in which the cathode means comprise two pulleys, one opposite each central opening of the elongated cylindrical portion of the tube.

5. The apparatus of claim 1 in which the means for adding the plating solution to the t-inlet comprises a pump and a filter.

* * * * *